US010499726B2

(12) United States Patent
Moskovich et al.

(10) Patent No.: US 10,499,726 B2
(45) Date of Patent: Dec. 10, 2019

(54) ORAL CARE SYSTEM AND METHOD

(71) Applicant: COLGATE-PALMOLIVE COMPANY, New York, NY (US)

(72) Inventors: Robert Moskovich, East Brunswick, NJ (US); Matthew Kolb, Upper Black Eddy, PA (US)

(73) Assignee: Colgate-Palmolive Company, New York, NY (US)

( * ) Notice: Subject to any disclaimer, the term of this patent is extended or adjusted under 35 U.S.C. 154(b) by 119 days.

(21) Appl. No.: 15/503,631

(22) PCT Filed: Aug. 14, 2014

(86) PCT No.: PCT/US2014/051121
§ 371 (c)(1),
(2) Date: Feb. 13, 2017

(87) PCT Pub. No.: WO2016/024981
PCT Pub. Date: Feb. 18, 2016

(65) Prior Publication Data

US 2017/0238689 A1 Aug. 24, 2017

(51) Int. Cl.
*B65D 35/28* (2006.01)
*A46B 11/00* (2006.01)
*A46B 9/04* (2006.01)

(52) U.S. Cl.
CPC ..... *A46B 11/0055* (2013.01); *A46B 9/04* (2013.01); *A46B 11/0041* (2013.01); *A46B 2200/1066* (2013.01); *B65D 35/285* (2013.01)

(58) Field of Classification Search
CPC ..... B65D 35/24; B65D 35/28; B65D 35/285
(Continued)

(56) References Cited

U.S. PATENT DOCUMENTS 2,876,934 A * 3/1959 Brim ..... B65D 35/285 222/102
3,917,118 A 11/1975 Odgen
(Continued)

FOREIGN PATENT DOCUMENTS

CN 201178794 Y 1/2009
CN 102655786 9/2012
(Continued)

OTHER PUBLICATIONS

International Search Report and the Written Opinion of the International Searching Authority issued in international application PCT/US2014/051121 dated May 4, 2015.

*Primary Examiner* — David J Walczak
*Assistant Examiner* — Joshua R Wiljanen

(57) ABSTRACT

An oral care system includes a toothbrush and a dispenser detachably coupled to the toothbrush. The dispenser includes a collapsible bladder containing an oral care material. A compression device assembly includes an actuator operably coupled to a compression device movably mounted inside the dispenser. In one embodiment, the compression device includes a feed slot that engages opposite sides of the collapsible bladder. Actuating the actuator translates the compression device in a first longitudinal direction extruding and dispensing the oral care material from the oral care product dispenser. The actuator may be slideably mounted to the dispenser in one embodiment. A ratcheting mechanism may be provided to provide indexed movement of the compression device, thereby dispensing predetermined doses of the oral care material with each indexed movement.

21 Claims, 9 Drawing Sheets

(58) Field of Classification Search
USPC ..... 401/145, 155, 156, 163; 222/95, 96, 101
See application file for complete search history.

(56) References Cited

U.S. PATENT DOCUMENTS

| | | | | |
|---|---|---|---|---|
| 4,020,976 | A | 5/1977 | Mineo | |
| 4,220,260 | A | 9/1980 | Webster | |
| 4,450,982 | A | 5/1984 | Ferreira | |
| 4,763,815 | A | 8/1988 | Von Schuckmann et al. | |
| 4,826,341 | A | 5/1989 | Kwak | |
| 5,382,106 | A | 1/1995 | Voigt | |
| 6,789,703 | B2 | 9/2004 | Pierre-Louis | |
| 6,968,978 | B1 | 11/2005 | Matthews | |
| 7,237,974 | B2 * | 7/2007 | Pfenniger | A46B 15/0055 401/118 |
| 7,975,386 | B1 * | 7/2011 | Halvorson | A47J 43/28 222/102 |
| 9,173,477 | B2 | 11/2015 | Jimenez et al. | |
| 2002/0047022 | A1 * | 4/2002 | Chernov | B65D 35/28 222/103 |
| 2002/0114658 | A1 | 8/2002 | Allen et al. | |
| 2003/0150472 | A1 | 8/2003 | Johnson | |
| 2007/0034645 | A1 | 2/2007 | Kafcsak | |
| 2010/0290829 | A1 | 11/2010 | McCoy et al. | |
| 2011/0308030 | A1 | 12/2011 | Jimenez et al. | |

FOREIGN PATENT DOCUMENTS

| | | |
|---|---|---|
| DE | 34 23 400 | 1/1986 |
| DE | 195 34 912 | 3/1997 |
| DE | 197 05 185 | 8/1998 |
| EP | 0 248 278 | 12/1987 |
| EP | 0 612 490 | 8/1994 |

* cited by examiner

ORAL CARE SYSTEM AND METHOD

BACKGROUND

Oral care materials or agents may be applied in variety of ways. For tooth whitening products, for example, a common technique used for applying tooth whitening products is to cast an impression of a person's teeth and provide a tray of the shape of this impression. A user then adds a whitening composition to the tray and applies the tray to his/her teeth. The tray is left in place for a period of time and then removed. Another technique is to use a whitening strip that has a whitening composition on one surface. This strip is applied to a person's teeth and left in place for a period of time. Yet another technique is to apply a whitening composition to teeth using a small brush. This brush is repeatedly dipped back into the container during the application of the tooth whitening composition to one's teeth. After a few treatments, the teeth gradually whiten using the foregoing techniques.

The foregoing approaches to oral care material storage, dispensing, and application may not be convenient and readily portable for travel. The oral care product is typically stored separately from the oral care tooth cleaning implements such as a toothbrush and treated as distinct parts of an oral care regimen which must be handled and packed separately.

A more portable, compact, and convenient way to store, dispense, and apply oral care materials to oral surfaces is desired.

BRIEF SUMMARY

According to one embodiment, an oral care system includes a toothbrush including a head and a handle having an internal cavity coupled to the head, and a dispenser detachably mounted into the internal cavity of the handle. The dispenser includes a housing having an internal chamber and a longitudinal axis, a collapsible bladder disposed in the chamber, the collapsible bladder containing an oral care material, an actuator mounted to the housing, and a compression device movably mounted within the chamber and operably coupled to the actuator. The compression device comprises a feed slot through which the collapsible bladder extends. The compression device engages opposite sides of the collapsible bladder to compress a portion of the collapsible bladder located in the feed slot. Actuation of the actuator translates the compression device in a first longitudinal direction in the internal chamber to dispense the oral care material from the dispenser. In one embodiment, the actuator is slideably movably on the housing in the first longitudinal direction.

According to one embodiment, an oral care product dispenser includes a housing having an internal chamber and a longitudinal axis, a collapsible bladder disposed in the chamber, the collapsible bladder containing an oral care material, an actuator mounted to the housing, and a compression device movably mounted within the chamber and operably coupled to the actuator. The compression device comprises a feed slot through which the collapsible bladder extends. The compression device engages opposite sides of the collapsible bladder to compress a portion of the collapsible bladder located in the feed slot. Actuation of the actuator translates the compression device in a first longitudinal direction in the internal chamber to dispense the oral care material from the oral care product dispenser.

A method for dispensing an oral care material is provided. The method includes: providing a dispenser including a longitudinal axis, an internal chamber, a collapsible bladder disposed in the chamber and containing an oral care material, and a compression device movably mounted within the chamber; actuating an actuator operably coupled to the compression device; translating the compression device in a first longitudinal direction; engaging opposite sides of the collapsible bladder with the compression device; and extruding the oral care material from the dispenser. In one embodiment, the actuating step includes slideably moving the actuator in the first longitudinal direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
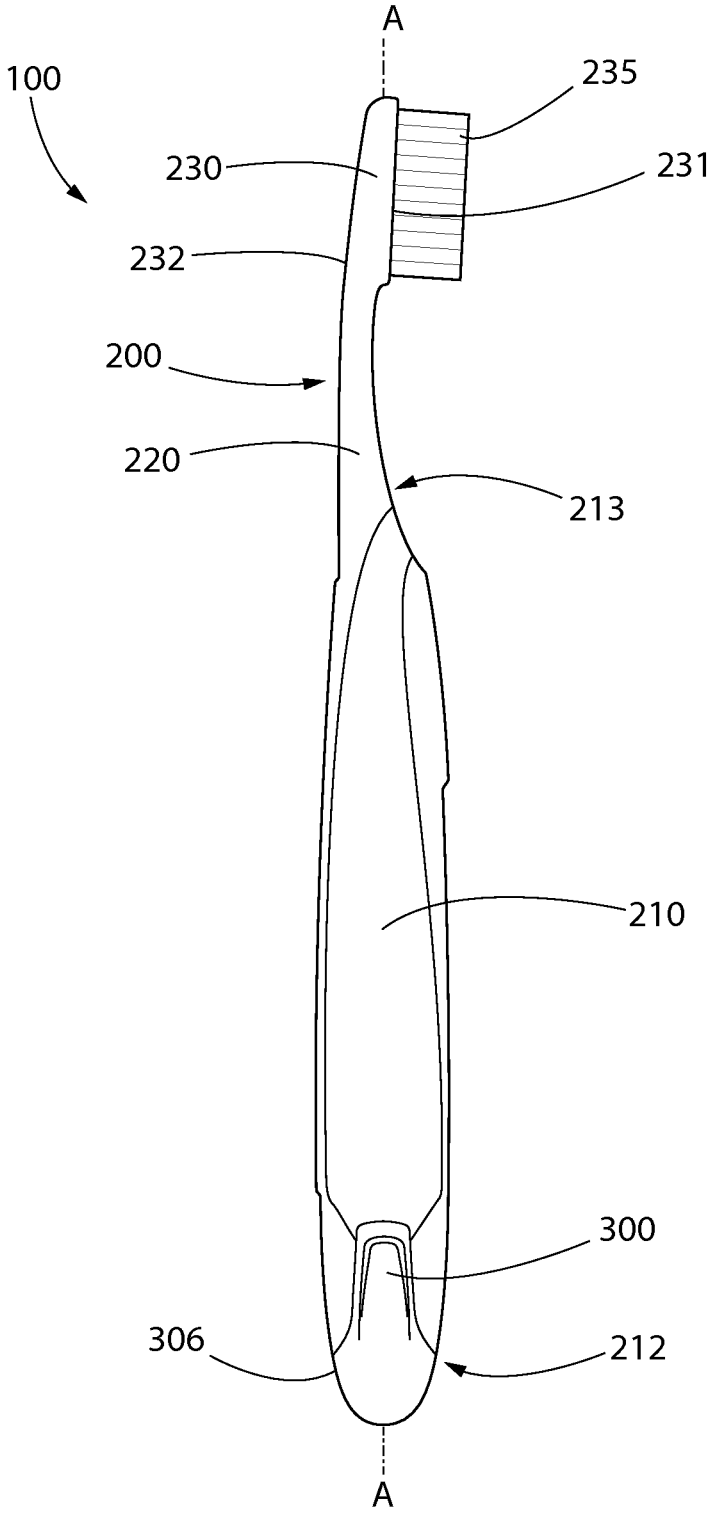
FIG. 1 is a side elevation view of an oral care system including a toothbrush and a fluid dispenser according to one embodiment of the present invention, wherein the dispenser is detachably coupled to the toothbrush.

All drawings are schematic and not necessarily to scale.

DETAILED DESCRIPTION

The following description of the preferred embodiment(s) is merely exemplary in nature and is in no way intended to limit the invention, its application, or uses. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
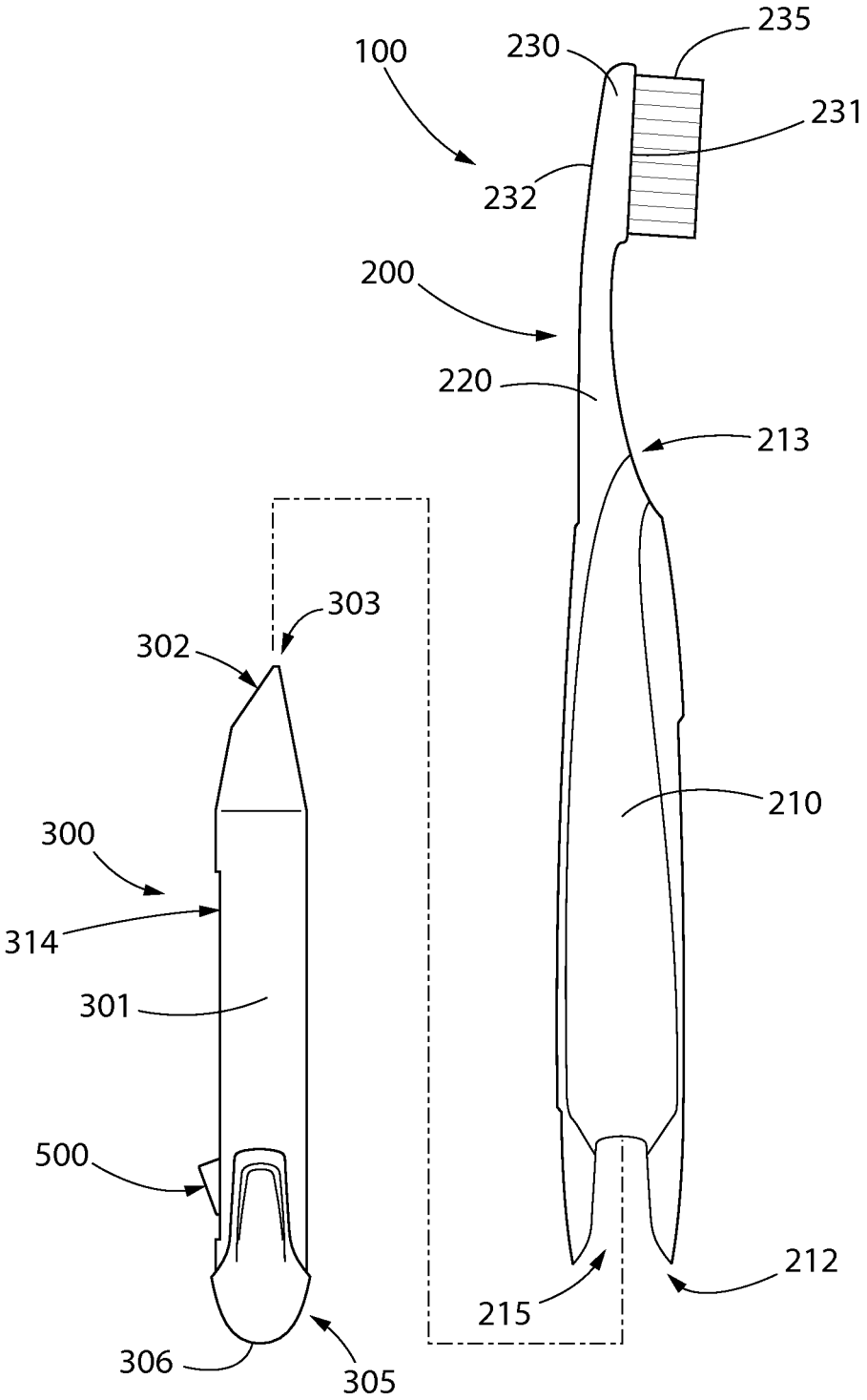
FIG. 2 is an exploded view thereof.
Figure 3:
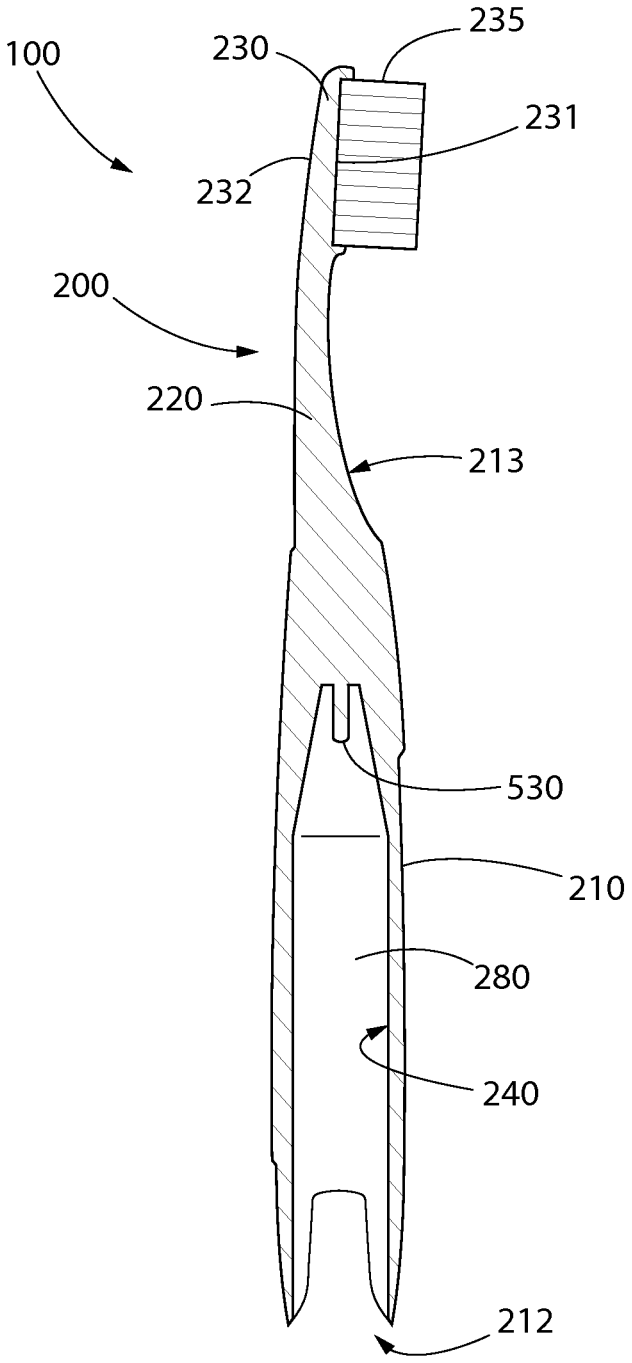
FIG. 3 is a side cross-sectional view of the toothbrush with dispenser removed.

Referring to FIGS. 1-3, an oral care system 100 according to the present invention includes an oral care device such as toothbrush 200 and an oral care material dispenser 300. In one embodiment, the dispenser 300 may be detachably stored in the toothbrush 200 as further described herein. Because the dispenser 300 is stored within the toothbrush 100, the oral care system 100 is highly portable for travel, easy to use, and reduces the amount of required luggage space. Furthermore, by housing the toothbrush 200 and dispenser 300 together, the user is less likely to misplace the dispenser 300 and more inclined to maintain the oral treatment routine with the dispenser since brushing will remind the user to simply detach and apply the contents of the dispenser 300 to complete the oral care treatment regimen.

In exemplary embodiments, the oral care material M may include without limitation the following types of flowable compositions in fluid form: tooth whitening, antibacterial, enamel protection, anti-sensitivity, anti-inflammatory, anti-attachment, fluoride, tartar control/protection, flavorant, sensate, colorant and others. However, other embodiments may be used to store and dispense any suitable type of flowable oral care material M. Accordingly, the invention is expressly not limited to any particular type of oral care material M.

With continuing reference to FIGS. 1-3, the toothbrush 200 has an elongated body and generally includes a handle 210, a neck 220 and a head 230. The handle 210 is configured for gripping by a user to manipulate the toothbrush 200 during brushing. In one embodiment, the handle 210 is configured to detachable store the dispenser 300 therein, as further described herein. Handle 210 may be formed of many different shapes, sizes, and materials formed by a variety of manufacturing methods that are well-known to those skilled in the art. If desired, the handle 210 may include a suitable textured grip made of soft elastomeric material. The handle 210 can be a single or multi-part construction. The handle 210 extends axially from a proximal end 212 to a distal end 213 along a longitudinal axis A-A of the toothbrush 200.

In one embodiment with continuing reference to FIGS. 1-3, handle 210 is an elongated and at least partially hollow structure defining an internal cavity 280 cooperatively configured with dispenser 300 to allow the dispenser to be detachably housed within the cavity until removed and deployed. An opening 215 is provided at proximal end 212 of the handle 210 that provides a passageway into the cavity through which the dispenser 300 can be inserted and retracted. While the opening 215 is located at the proximal end 212 of the handle 210 in the exemplified embodiment, the opening 215 may be located at other positions on the handle 210 in other embodiments of the invention. For example, the opening 215 may be located on a longitudinal surface of the handle 210 (e.g., the front surface, the rear surface and/or either of the opposing side surfaces) in which case the opening 215 is axially elongated to provide sufficient access to the cavity 280 for inserting the dispenser 300.

The handle 210 transitions into the neck 220 at the distal end 213. While the neck 220 generally may have a smaller transverse cross-sectional area than the handle 220, the invention is not so limited. Broadly speaking, the neck 220 is merely the transition region between the handle 210 and the head 230 and can conceptually be considered as a portion of the handle 210 or a portion of the head 230. The head 230 and/or neck 220 may therefore be considered as connected to the distal end 213 of the handle 210.

The head 230 and handle 210 of toothbrush 200 may be formed as a single unitary structure using a molding, milling, machining or other suitable process known in the art. However, in other embodiments, handle 210 and head 230 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 230 and handle 210 are of a unitary or multi-piece construction (including connection techniques) is not limiting of the present invention, unless specifically claimed. In some embodiments of the invention, a replaceable type head 230 may be provided which is detachably mounted to the handle 210 (along with a portion of neck 220) using techniques known in the art, such as disclosed in PCT International Patent Application No. PCT/US2012/042973 filed Jun. 18, 2012, which is incorporated herein by reference in its entirety.

Head 230 generally includes a front surface 231, a rear surface 232 and a peripheral side surface 233 that extends between the front and rear surfaces 231, 232. The front surface 231 of the head 230 includes a plurality of oral cleaning elements such as tooth engaging elements 235 extending therefrom for cleaning and/or polishing contact with an oral surface and/or interdental spaces. While the tooth engaging elements 235 are suited for brushing teeth, the tooth engaging elements 235 can also be used to polish teeth instead of or in addition to cleaning teeth. As used herein, the term "tooth engaging elements" is used in a broad generic sense to refer to any structure that can be used to clean, polish or wipe the teeth and/or soft oral tissue (e.g. tongue, cheek, gums, etc.) through relative surface contact. Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Tooth engaging elements 235 of the present invention can be connected to the head 230 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

Toothbrush 200 and the dispenser 300 are non-unitary separate structures that are specially designed and configured to be detachably coupled together when in an assembled state (referred to herein as a "storage state") and completely isolated and separated from one another when in a disassembled state (referred to herein as an "application state"). The toothbrush 200 and the dispenser 300 are illustrated in the storage state in FIG. 1 and in the application state in FIG. 2. The dispenser 300 can be slidably manipulated and altered between the storage state (FIG. 1) in which the dispenser 300 is located (or docked) in the toothbrush handle 210 and the application state (FIG. 5) in which the dispenser 300 is removed from the handle 210 by the user as desired.

FIGS. 4A-B and 5A-B illustrate one non-limiting embodiment of a dispenser 300 accordingly to the present invention. Dispenser 300 may be an elongated tubular pen-like structure that extends along a longitudinal axis B-B. The dispenser 300 comprises an elongated housing 301, an applicator 302 located in and closing an open distal end 303 of the housing 301, and a proximal end 305 of the housing 301. Distal end 303 may be considered to define a forward end or location and proximal end 305 may be considered to define a rear end or location of dispenser 300. The distal end 303 portion of dispenser 300 may be frusto-conical shaped in some embodiments.

Housing 301 may be a generally circular transverse cross-sectional profile in one embodiment. Of course, in other embodiments, the transverse cross-sectional profile of the housing 301 can take on various non-circular shapes. The housing 301 is constructed of a material and with a wall thickness that is sufficiently rigid to provide the necessary structural integrity and stiffness for handling and dispensing of an oral care material M from the dispenser 300 without substantial deformation. For example, the housing 301 can be formed of a moldable hard plastic. Suitable hard plastics include polymers and copolymers of ethylene, propylene, butadiene, vinyl compounds and polyesters such as polyethylene terephthalate. Others may be used and the invention is not limited to any particular material of construction.

While the housing 301 is exemplified as a single layer construction, in certain embodiments, the housing 301 may be a multilayer construction. In certain multi-layer embodiments, an inner layer can be formed from the hard plastic materials described immediately above while an outer layer can be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness. While an over-molding construction is one suitable method of forming the outer layer, a suitable deformable thermoplastic material, such as TPE, may be formed in a thin layer and attached to inner layer with an appropriate adhesive, sonic welding, or by other means.

Housing 301 of dispenser 300 is an elongated hollow tubular structure extending along the longitudinal axis B-B from the proximal end 305 to the distal end 303. The housing 301 comprises an outer surface 314 and an inner surface 315 that forms an elongated internal chamber 316 for housing collapsible bladder 317. In one embodiment, proximal end 305 may be open before closure by end cap 306 thereby providing access to chamber 316 for insertion of the collapsible and squeezable collapsible bladder 317 which contains an oral care material M. Proximal end 305 may further be closed by an end wall 406, as described herein.

With continuing reference to FIGS. 4A-B and 5A-B, collapsible bladder 317 is axially elongated extending from proximal end 305 to the distal end 303 of dispenser housing 301. A first proximal end 400 of the collapsible bladder may be sealed by a suitable means such as without limitation heat sealing, crimping, ultrasonic welding, adhesives, or other. An opposing second distal end 401 of the collapsible bladder may be terminated with a nozzle 402 having an opening or orifice formed therein for dispensing the oral care material M from the collapsible bladder 317. The collapsible bladder 317 includes flexible deformable sidewalls 403 extending circumferentially around the bladder which are structured to be compressed and collapsed by compression device 503 for dispensing oral care material M, as further described herein. In an undeformed state filled with the oral care material M, sidewalls 403 of collapsible bladder 317 may be a generally circular shape in transverse cross-section at least towards the middle and nozzled distal end 401 sections of the bladder. The collapsible bladder 317 may assume a more flattened somewhat rectangular shape near the closed proximal end 400 (see, e.g. FIGS. 5A-B). Other cross-sectional collapsible bladder shapes, however, may be provided which are useable with embodiments of the present invention.

Collapsible bladder 317 contains the desired flowable oral care material M, which can contain any active oral care agent and/or inactive ingredients. The oral care agent and/or its carrier may be in any form of a fluidic or flowable material including without limitation viscous pastes/gels or less viscous liquid compositions. Any suitable oral care material M can be stored in collapsible bladder 317 and used in the present invention. For example, the oral care material M may include any oral care agents such as without limitation oxidative or whitening agents with peroxide-containing chemical compositions which are well known in the art. Other contemplated fluidic oral care materials useable with the present invention include, without limitation: antibacterial agents; enamel strengthening or repair agents; tooth erosion preventing agents; anti-sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents; anti-inflammatory agents; dry mouth relief ingredients; catalysts to enhance the activity of any of these agents; colorants or aesthetic ingredients; dentifrice or toothpaste; and combinations thereof. In some embodiments, the oral care material M does not contain dentifrice or toothpaste and is instead contains active agents or ingredients that provide supplemental oral care benefits in addition to merely brushing one's teeth. Other suitable fluids could include lip balm or other similar materials that are typically available in a highly viscous semi-solid yet flowable state that may be extruded from collapsible bladder 317, as further described herein.

With continuing reference to FIGS. 4A-B and 5A-B, applicator 302 may include a dispensing orifice 318 through which the oral care material M stored in collapsible bladder 317 can be dispensed from the dispenser 300. In one embodiment, dispensing orifice 318 extends axially through applicator 302 and forms a fluid conduit that is in fluid communication with collapsible bladder 317 and nozzle 402 for receiving and discharging the oral care material M to the oral surfaces of the user or toothbrush 200 (e.g. toothpaste). In one embodiment, the dispensing orifice 318 may be located in a transversely angled or slanted exposed forward end wall 404 of applicator 302. End wall 404 defines and exposed surface and is angled forward and in relation to the longitudinal axis B-B, which facilitates the application of the oral care material M to the teeth, gums, lips, or other oral surfaces. The rear of applicator 302 includes a rear or proximally projecting tubular socket 405 configured for insertion of nozzle 402 from collapsible bladder 317 as shown. Tubular socket 405 fluidly and mechanically couples the collapsible bladder to the applicator 302. Socket 405 has a central passageway which is in fluid communication with nozzle 402 on collapsible bladder 317 and orifice 318. Other suitable ways of coupling nozzle 402 to applicator 302 are possible.

In certain alternative embodiments using a liquid and low viscosity oral care material M fluid, a porous applicator 302 may be provided which is constructed of a material that supports capillary fluid transport. Various porous polymeric foams or other suitable capillary materials may be used. In such embodiments, dispensing orifice 318 may be omitted as the entire porous applicator will conduct the fluidic oral care material M from the collapsible bladder nozzle 402 to the exposed surface on front wall 404 for application to the target oral tissue. Furthermore, in certain other embodiments, the dispensing orifice 318 can be located in other areas of the housing 301, such as on one of the longitudinal side walls of the dispenser 300 and/or applicator 302. In some embodiments, a plurality of dispensing orifices 318 can be provided. For example, the plurality of dispensing orifices 318 can be provided in a generally circular configuration that may be used to facilitate the fluid being dispensed through the applicator 302.

In one embodiment, applicator 302 may be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness.

In alternative embodiments, the applicator 302 may be constructed of bristles, a porous or sponge material, or a fibrillated material. Suitable bristles include any common bristle material such as nylon or PBT. The sponge-like materials can be of any common foam material such as urethane foams. The fibrillated surfaces can be comprised of various thermoplastics. The invention, however, is not so limited and the applicator 302 can be any type of surface and/or configuration that can apply a viscous substance onto the hard surface of teeth, including merely an uncovered opening/orifice.

The applicator 302 may have a generally circular transverse cross section fitted at least partially into open distal end 303 of dispenser 300. Applicator 302 may be flushed mounted with the distal end 303 of dispenser 300 in some embodiments as shown in FIGS. 4A-B and 5A-B. In other embodiments, the applicator protrudes beyond the front end surfaces of the dispenser 300. Either arrangement may be used.

Referring to 4A-B and 5A-B, proximal end 305 of dispenser housing 301 may have any suitable configuration. In one embodiment, open proximal end 305 may be closed by a rear end wall 406. End wall 406 may be flat in one embodiment, or have another suitable configuration in other embodiments including angled, curved, or other. The end wall 406 may be constructed to be inserted into open end 305 of housing 301 after insertion of the collapsible bladder 317. The end wall 406 may be a separate unitary structure or in other embodiments be an integral unitary part of end cap 306 which is affixed to the proximal end 305 of the dispenser housing 301 (see also FIGS. 1 and 2).

End wall 406 of dispenser housing 301 may optionally be configured to include a clamping member 410 disposed on an interior surface inside internal chamber 316 of the dispenser 300. Clamping member 410 may have a split structure with upper and lower halves configured to grip opposing sides of the proximal end 400 of collapsible bladder 317. This holds the collapsible bladder in position during extraction of the oral care material M from the tube via compression device 503. This arrangement may be useful where the collapsible bladder 317 does not have a stiff enough structure to resist longitudinal crumpling when the oral care material M is extruded from the tube if the proximal end 400 were not affixed to the proximal end 305 of dispenser 300 via the clamping member 410. In one embodiment, the proximal end 400 of collapsible bladder 317 may be releasably affixed to proximal end 305 of dispenser 300. In certain embodiments, the proximal end 400 of the collapsible bladder 317 is non-movably coupled or fixed to the housing 301 of the dispenser 300. This ensures that the collapsible bladder 317 remains substantially stationary within the housing 301 as the compression device 503 moves within the internal chamber 316. Thus, as the compression device 503 translates within the internal chamber 316, the collapsible bladder 317 does not move in the axial direction but rather the proximal end 400 of the collapsible bladder 317 remains in the same location within the internal chamber 316. It will be appreciated that in some embodiments, clamping member 410 may be omitted.

Figure 5A:
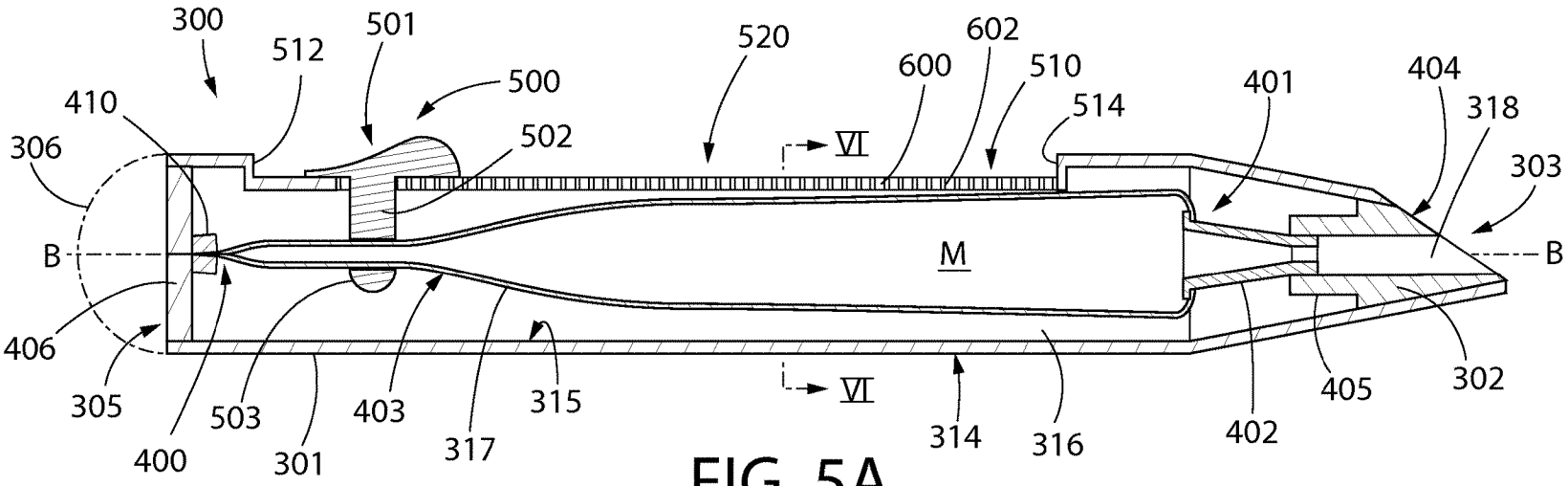
FIGS. 5A and 5B are side cross-sectional views of the dispenser with FIG. 5B showing an oral care material being dispensed.
Figure 5B:
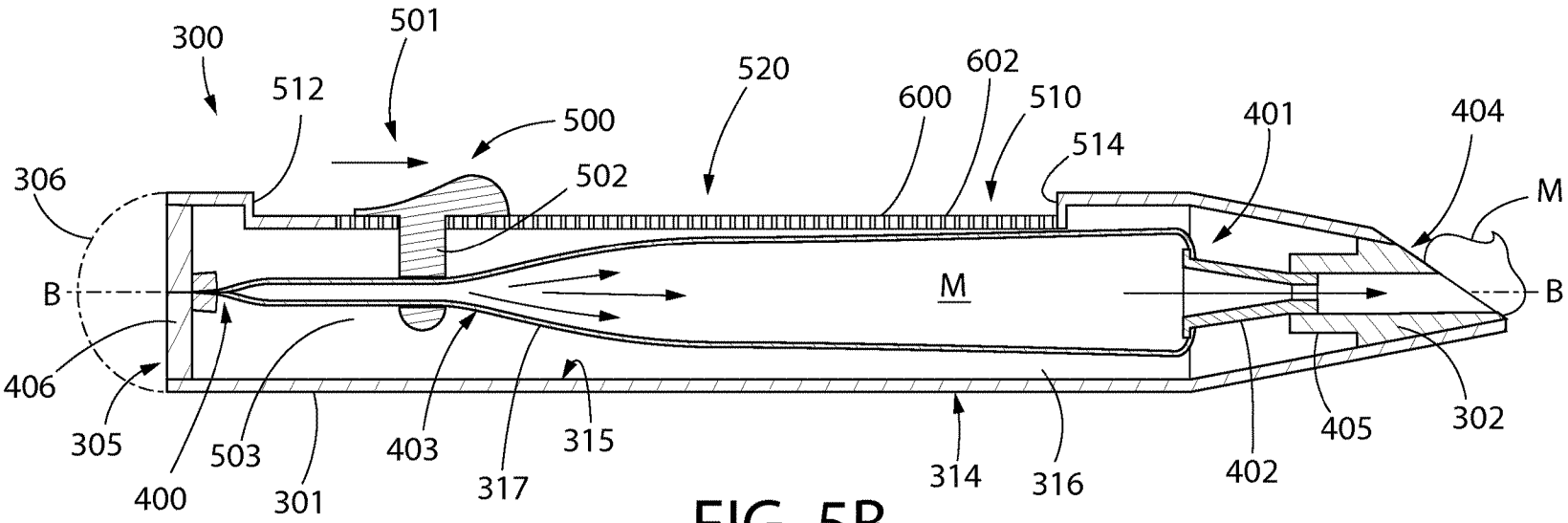
Figure 6:
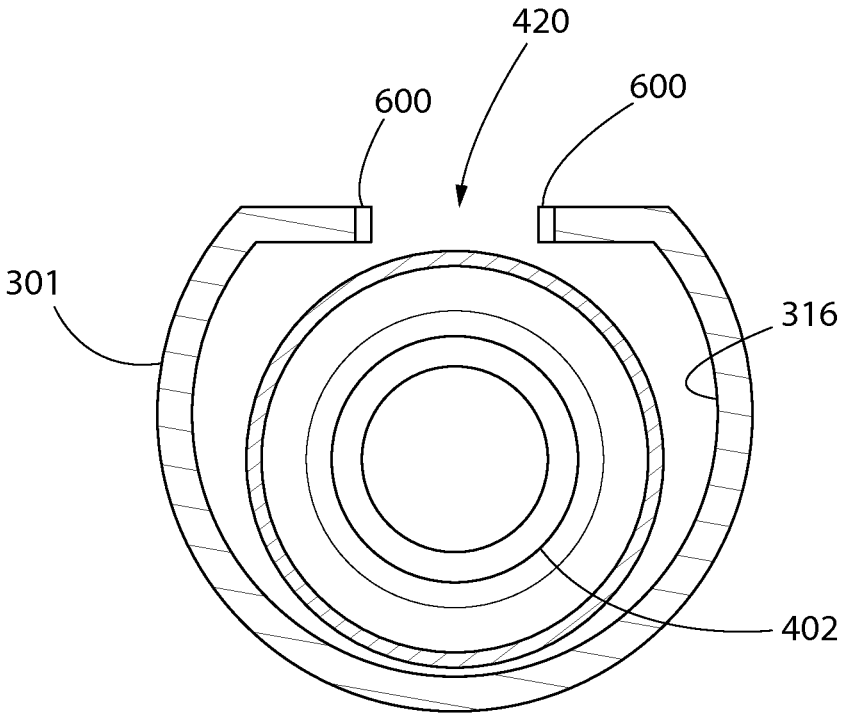
FIG. 6 is a transverse cross-sectional view of the dispenser taken along line VI-VI in FIG. 5A.

In one embodiment, as best shown in FIGS. 5A-B, the collapsible bladder 317 is primarily supported at the rear distal end 400 by end wall 406 of dispenser housing 301 and at the distal end 401 at nozzle 402 by applicator 302. In addition to the foregoing fixed or stationary supports, in one embodiment the collapsible bladder 317 is further supported between the ends by compression device 503 which is configured to provide a slidable intermediary support for the tube, as further described herein.

The compression device assembly 500 and the oral care material M dispensing mechanism will now be further described with reference to FIGS. 4A-B and 5A-B. In one embodiment, housing 301 of dispenser 300 includes a longitudinally-extending operating slot 520 extending between distal end 303 and proximal end 305 of dispenser 300. Operating slot 520 slideably receives and retains a portion of the compression device assembly 500 which includes compression device 503. This guides the compression device 503 in a linear path along the longitudinal axis B-B of the dispenser 300. Compression device 503 is axially moveable or translatable from the proximal end 305 to distal end 303 of dispenser 300. In certain embodiments, the compression device 503 translates within the internal chamber 316 without rotation.

Figure 7A:
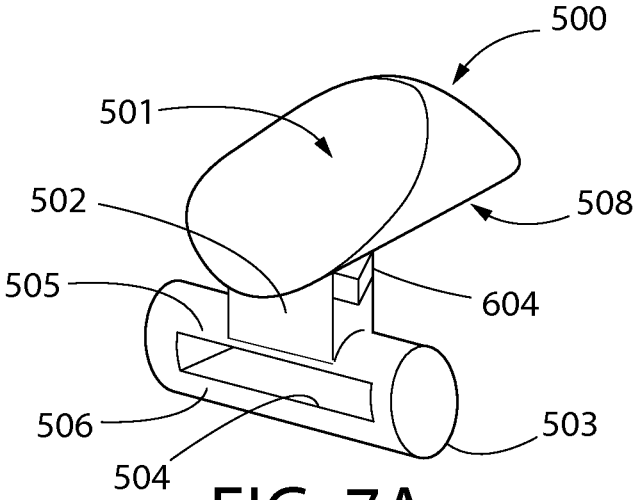
FIG. 7A is a perspective view of the compression device assembly of the dispenser.
Figure 7B:
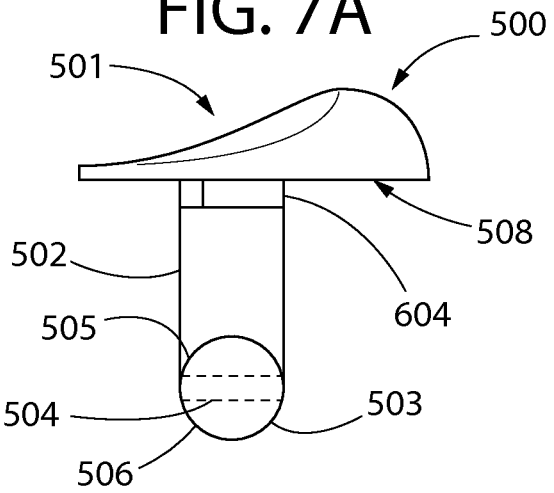
FIG. 7B is a side elevation view thereof.
Figure 7C:
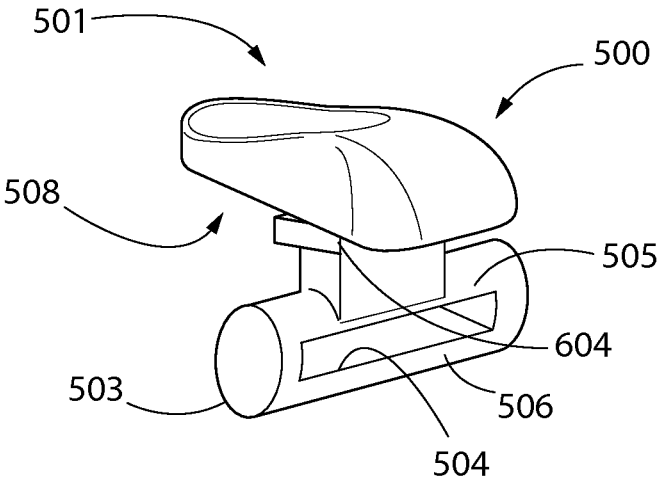
FIG. 7C is a rear end view thereof.

The compression device assembly 500 is shown in further detail in FIGS. 7A-C. Compression device assembly 500 provides a manually activated compression mechanism configured for dispensing oral care material M from collapsible bladder 317. In one embodiment, compression device assembly 500 includes an actuator 501 operably coupled to compression device 503 at opposite ends of a stem 502 which operably couples the compression device to the actuator. The compression device 503 moves linearly in unison with the actuator 501. The compression device assembly 500 may be formed of any suitable material, including plastic or metal. In one embodiment, compression device assembly 500 may be formed of injection molded plastic. Compression device assembly 500 may be one piece of unitary construction or alternatively some or all of the foregoing actuator parts may be separate and joined together by any suitable method such as ultrasonic welding, adhesives, fasteners, etc.

Actuator 501 rests on top of dispenser housing 301 and elongated operating slot 520, thereby forming a slider switch for dispensing oral care material M. Actuator 501 may have any suitable configuration and may be shaped to facilitate engagement with a user's finger or thumb. In one embodiment, the actuator 501 may have a substantially flat underside or bottom surface 508 that slideably engages mating flat top surfaces 510 formed on either side of operating slot 420. Top surfaces 510 may extend axially along the longitudinal axis B-B for a majority of the length of dispenser 300. The top surfaces 510 may terminate at a rear vertical wall 512 and front vertical wall 514 in dispenser housing 301. The vertical walls 512, 514 provide limit stops which restrict the maximum axial movement possible for compression device assembly 500. As convenient points of reference, top surfaces 510 define the top of dispenser housing 301. The bottom of housing 301 is defined as that part of the housing 301 lying opposite top surfaces 510 and lateral sides as the opposing parts of housing 301 extending between the top and bottom.

Stem 502 is affixed to the bottom of actuator 501 or may be formed as an integral unitary part thereof. Stem 502 is configured and dimensioned to be inserted through operating slot 420 of dispenser 300. In one embodiment, stem 502 may have a rectilinear transverse cross-sectional shape (e.g. square or rectangular); however, other suitable cross-section shapes such as without limitation circular or ovoid may be used.

Figure 4A:
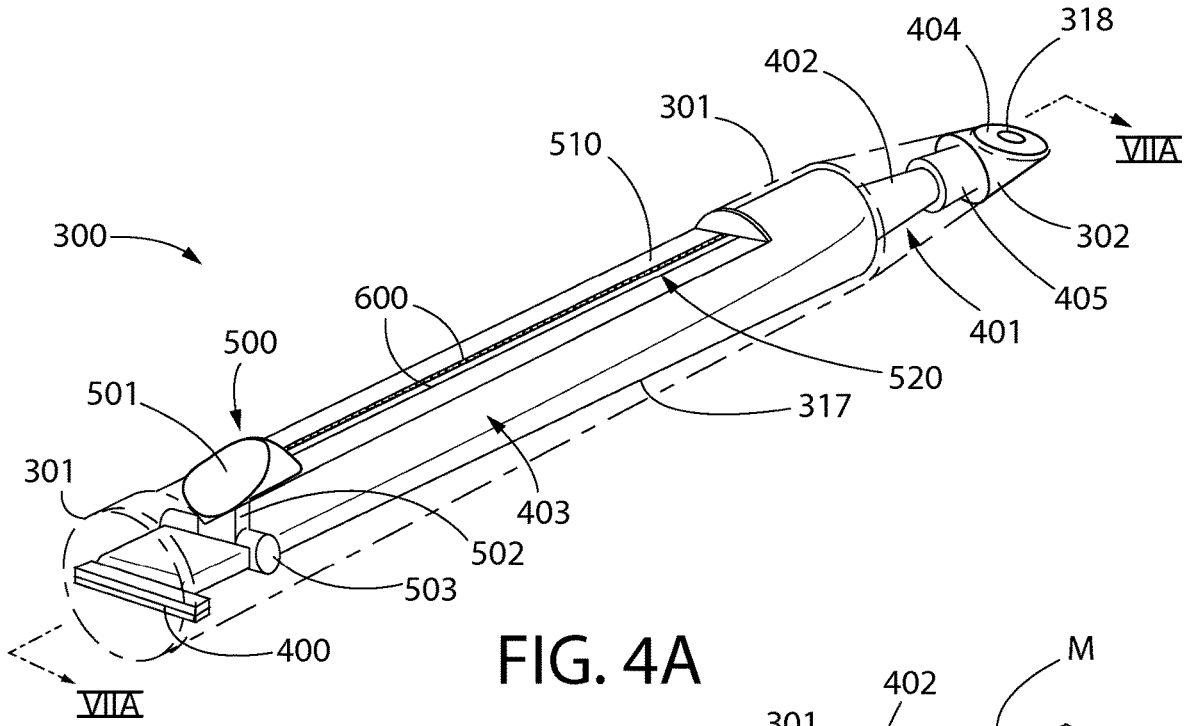
FIGS. 4A and 4B are perspective views of the dispenser with FIG. 4B showing an oral care material being dispensed.
Figure 4B:
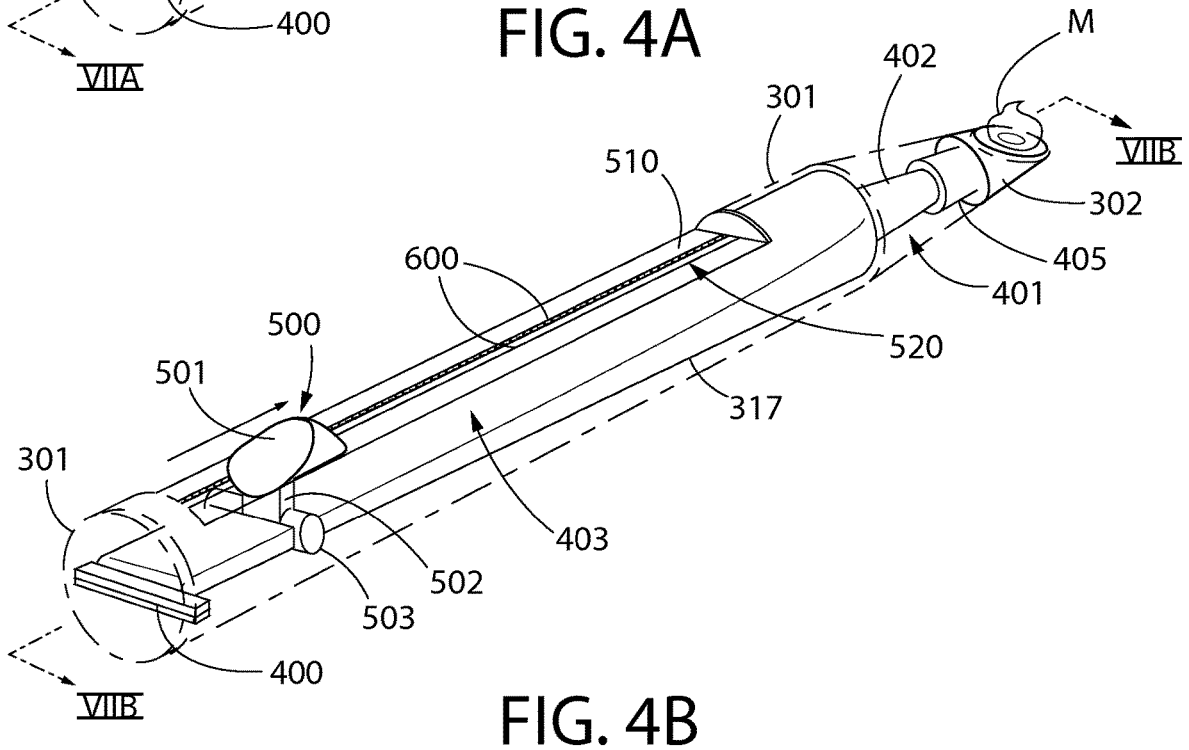

With continuing reference to FIGS. 7A-C, compression device 503 may be laterally elongated in a direction transverse to longitudinal axis B-B preferably having a larger lateral width that the lateral width of collapsible bladder 317 at the portion engaged with feed slot 504 (see also FIGS. 4A-B). Compression device 503 may further have a larger lateral width than adjoining stem 502 and operating slot 420 in some embodiments. The compression device 503 is disposed in internal chamber 316 of dispenser housing 301 and linearly translatable within the housing.

Compression device 503 may be configured to simultaneously engage opposite sides of collapsible bladder 317 for squeezing or extruding oral care material M from the tube. In one exemplary embodiment, compression device 503 includes laterally elongated feed slot 504 defined by an upper horizontal wall 505 and opposing lower horizontal wall 506 each engaging top and bottom portions of deformable sidewalls 403 of the collapsible bladder 317. The proximal end 400 of the collapsible bladder 317 is insertable through the slot 504 allowing the compression device 503 to be progressively translated along the tube towards proximal end 401 for extruding and dispensing the oral care material M. Lateral side portions of compression device 503 adjacent slot 504 are disposed on either lateral side of collapsible bladder 317 (see FIGS. 4A-B). Although described and illustrated herein as being laterally elongated, in certain embodiments the feed slot 504 may not be elongated and may merely be an opening of any shape and size through which the proximal end 400 of the collapsible bladder 317 may be inserted. In one embodiment, compression device 503 may have a generally cylindrical shape as seen in FIGS. 7A-C. Other suitable shapes including rectilinear or block shapes, however, may be used.

In other possible embodiments, compression device 503 may be linearly translated by means other than actuator 501. For example, compression device 503 may alternatively be moved in the axial direction by a drive screw rotated by turning a rotary knob actuator affixed to the proximal end 305 of dispenser housing 301. The drive screw includes external screw threads that engage a mating internally threaded through socket formed through the compression device 503. The slide-type actuator 501 may therefore be omitted in this embodiment. Similar mechanisms are described for example in commonly owned United States Patent Application Publication No. 2011/0308030, which is incorporated herein by reference in its entirety.

To deliver predetermined and premeasured doses of the oral care material M, dispenser 300 in some embodiments may include a ratchet mechanism associated with compression device assembly 500. The ratchet mechanism controls and provides indexed advancement of the compression device 503 linearly along the longitudinal axis B-B of dispenser 300. This allows a calculated dose of oral care material M to be dispensed through applicator 302 with each indexed movement of the compression device assembly 500.

Figure 8:
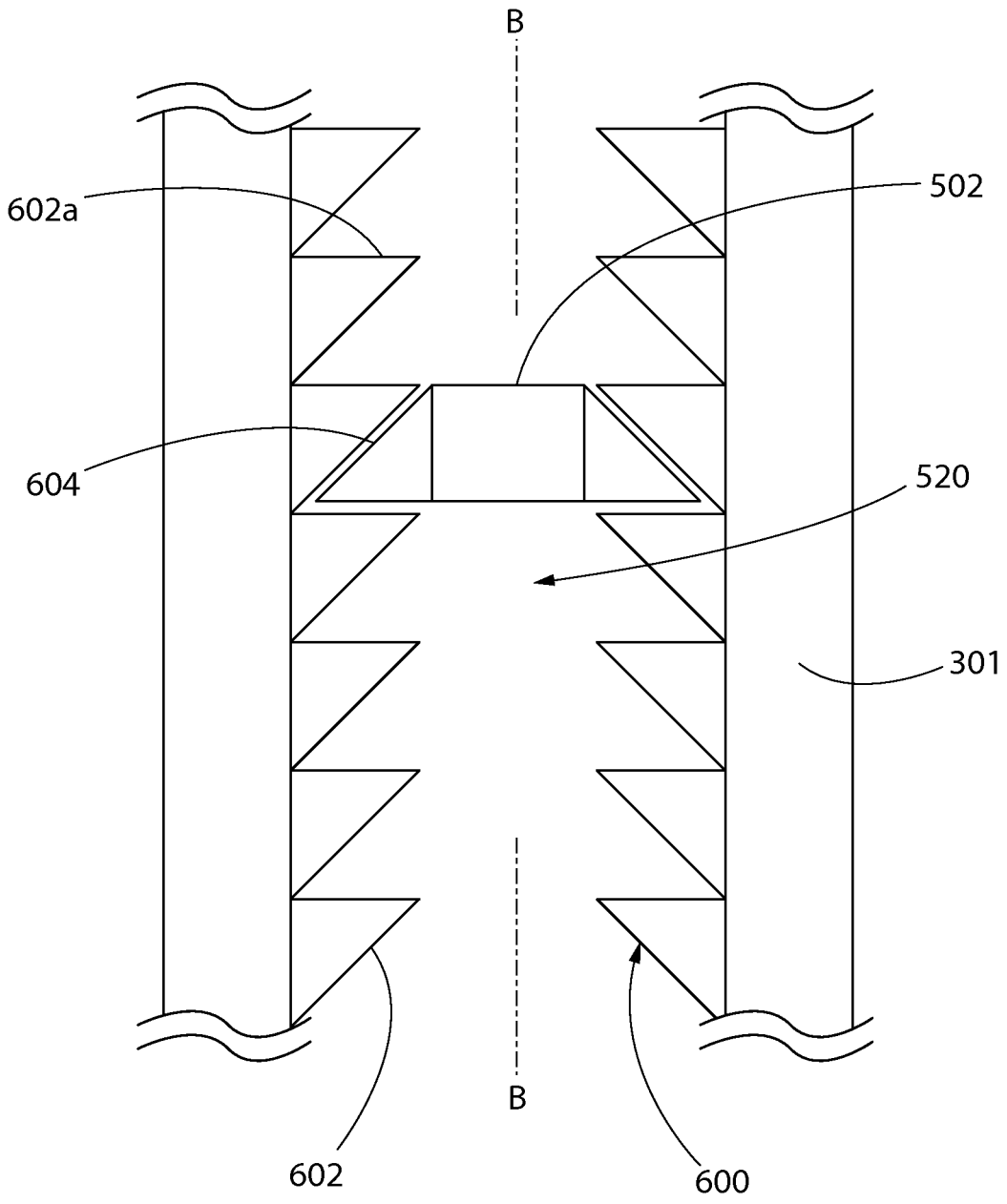
FIG. 8 is a top plan view of a ratchet mechanism of the dispenser.

Referring to FIGS. 4A-B, 5A-B, 6, 7A-C, and 8, the ratchet mechanism in one embodiment comprises a pair of opposing gear racks 600 and mating index protrusions 604 configured to slideably engage the gear racks. Gear racks 600 may be disposed on dispenser housing 301 on either side of elongated operating slot 420 (see, e.g. FIGS. 4A-B, 5A-B, and 6). Gear racks 600 each include a plurality of gear teeth 602 configured and arranged to engage a mating index protrusion 604 formed on actuator 501 and/or stem 502 of compression device assembly 500. In one embodiment, the gear teeth 602 of gear racks 600 are oriented to face inwards towards and project into operating slot 420 (see particularly FIG. 8). The gear teeth 602 may have any suitable configuration. In one embodiment, each gear tooth 602 may include a forward facing front surface 602*a* oriented perpendicular (i.e. 90 degrees) to longitudinal axis B-B as shown in FIG. 8. This front surface 602*a* engages a complementary configured perpendicular oriented rear surface 604*a* on index protrusion 604. This arrangement provides a one-way forward (distal) ratcheting action and movement of actuator 502 and compression device 503 in a first longitudinal or axial direction, thereby preventing or resisting rearward (proximal) movement of the compression device 503 via operation of the actuator 501. In other embodiments, the gear teeth 602 may each be configured with slanted or angled front and rear surfaces with respect to the longitudinal axis B-B (i.e. angle other than 90 degrees to B-B) to allow bi-directional movement of the actuator 501 and compression device 503 in the dispenser 300.

Figure 7D:
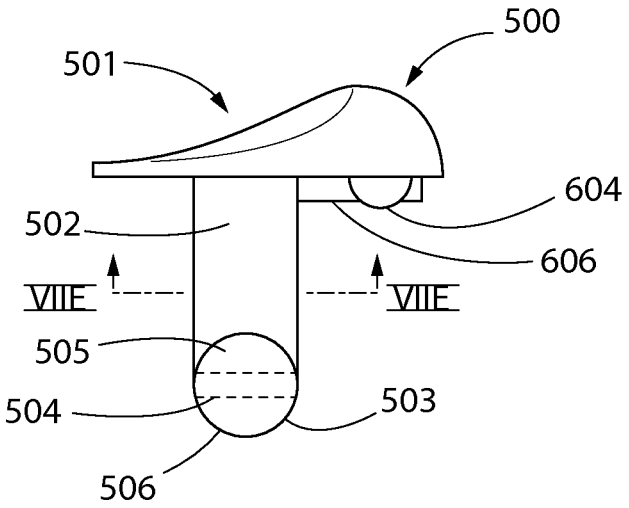
FIG. 7D is side elevation view of an alternative embodiment of a the compression device assembly.
Figure 7E:
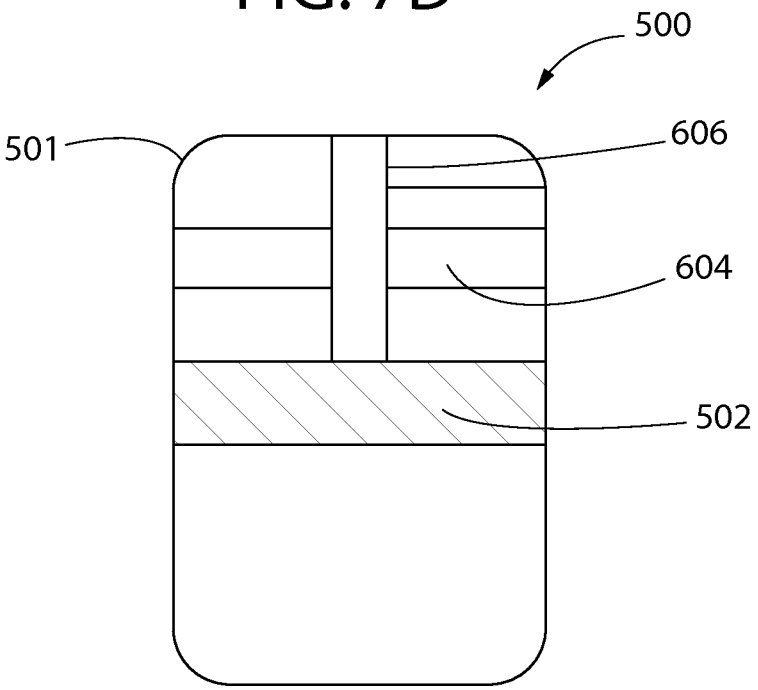
FIG. 7E is a transverse cross-sectional view thereof taken along line VIID-VIID in FIG. 7D and showing the underside structure of the actuator of the compression device assembly.

Index protrusions 604 may have any suitable configuration. In one embodiment, the index protrusions 604 may be configured as a single gear tooth disposed on opposing lateral sides of stem 502 beneath the actuator 501, as shown in FIGS. 7A-C and 8. The index protrusions 604 each protrude laterally outwards from the stem 502 in opposite directions to engage one of the gear racks 600 (best shown in FIG. 8). In an alternative embodiment, the index protrusions 604 may be mounted on the underside of actuator 501 as shown in FIGS. 7D-E and project downwards therefrom to engage the gear racks 600. In this arrangement, the index protrusions 604 may be disposed on opposing sides of an axially extending rail 606 formed on the underside of actuator 501. The rail 606 is configured and has a vertical depth allowing the rail to extend partially down into operating slot 420 between the gear racks 600 to guide the compression device assembly 500 linearly along the dispenser housing 301. In other embodiments, the rail 606 may be omitted. It will be appreciated that numerous other suitable configurations and arrangements of index protrusions 604 on compression device assembly 500 may be used to engage gear racks 600 and provided indexed movement of the compression device assembly 500.

Operation of the compression device assembly 500 will now be described with respect to the embodiment of dispenser 300 including the foregoing dosing ratchet mechanism. It will be appreciated, however, that certain embodiments may exclude a ratcheting mechanism.

In operation, a portion of the collapsible bladder 317 extends through feed slot 504 of compression device 503, as shown in FIGS. 4A-B and 5A-B. The compression device 503 simultaneously engages opposing deformable sidewalls 403 of collapsible bladder 317. Initially, the proximal end 400 of collapsible bladder 317 is inserted through the feed slot 504 when the dispenser 300 is first loaded with collapsible bladder 317 and contains a full volume or amount of oral care material M. The compression device assembly 500 is positioned more proximally near the rear or proximal end 305 of dispenser 300 in operating slot 420.

To dispense oral care material M, a user slides the actuator 501 towards the front or distal end 303 of dispenser 300 (see, e.g. FIG. 5B). This in turn linearly translates the compression device 503 forward or distally. The compression device 503 squeezes and pushes the oral care material M inside collapsible bladder 317 forward towards nozzle 402. The oral care material M flows through nozzle 402 into dispensing orifice 318, and then outwards from the applicator 302 for delivery to the target oral surfaces or an oral care implement such as toothbrush 100. Advantageously, since the compression device 503 engages both upper and lower sidewalls 403 of collapsible bladder 317, the delivery of oral care material M is efficient leaving little remaining oral care material in the collapsed portion of the bladder behind (i.e. rearward or proximal) of the compression device.

During the foregoing dispensing action, the index protrusions 604 advance in indexed fashion along the gear racks 600, thereby dispensing a predetermined amount of oral care material M with each indexed or stepped movement of the compression device assembly 500. In some embodiments, the meshing index protrusions 604 and gear teeth 602 of the gear racks 600 are configured to produce an audible "click" with each indexed movement of the compression device assembly 500. This allows the user to audibly confirm that the desired dose has been dispensed.

Referring to FIG. 1, the dispenser 300 is illustrated in the storage state. In the exemplified embodiment, when in the storage state the dispenser 300 is docked within the cavity 280 of the handle 210 of the toothbrush 200. However, the dispenser 300 may be detachably coupled to the handle 210 or other portions of the toothbrush 200 without being docked within the cavity 280 in other embodiments. In the exemplified embodiment, an interference fit between the outer surface 314 of the dispenser 300 and an inner surface 240 of the toothbrush 200 that forms the cavity 280 detachably couples and retains the dispenser 300 to the toothbrush 200. When the dispenser 300 is in the storage state, at least a portion, and preferably a majority, of the dispenser 300 is located within the internal cavity 280 of the toothbrush 200. The end cap 306 preferably exposed and outside of internal cavity 280 to be grasped by a user for axially withdrawing the dispenser 300 from the cavity.

In the exemplified embodiment, the entirety of the housing 301 of the dispenser 300, including the applicator 302, are located within the cavity 280 of the toothbrush 200 when the dispenser 300 is in the storage state. The end cap 306 of the dispenser 300, however, protrudes axially from the proximal end 212 of the handle 210 of the toothbrush 200. This allows a user to readily grasp, axially withdraw, and deploy the dispenser. In one embodiment, the end cap 306 may be dome shaped continues the natural curved contour of the handle 210. This conceals the dispenser 300 and provides a rounded proximal end to the oral care system 100, thereby providing a look that aesthetically resembles a traditional manual toothbrush. It will be appreciated that other suitable end cap 306 shapes may be provided.

To remove the dispenser 300 in the application state shown in FIG. 2, the user merely grasps end cap 306 and axially withdraws the dispenser from internal cavity 280 of toothbrush 200. With the dispenser 300 now undocked from toothbrush handle 210, the user may dispense the oral care material M in the manner described above by axially advancing the compression device assembly 500 towards the distal end 303 of the dispenser 300. When finished, the user may then axially reinsert the dispenser 300 into internal cavity 280 of toothbrush 200. In one embodiment, an axially elongated sealing plug 530 may be disposed near the distal end of toothbrush internal cavity 280 to help seal the dispensing orifice 318 in applicator 302 when the dispenser 300 is docked in the toothbrush handle 210. The sealing plug 530 is concentrically aligned with dispensing orifice 318 when dispenser 300 is positioned inside internal cavity 280 of toothbrush handle 210. This helps prevent inadvertent dispensing or leakage of oral care material M from dispenser 300 when docked.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care system comprising:

a toothbrush including a head and a handle coupled to the head;

a dispenser detachably mounted to the handle, the dispenser including:

a housing having an internal chamber and a longitudinal axis;

a collapsible bladder disposed in the chamber, the collapsible bladder containing an oral care material and including a distal end for dispensing the oral care material and a sealed proximal end;

the housing including a clamping member lockingly engaged with the proximal end of the collapsible bladder and holding the collapsible bladder in position during dispensing the oral care material;

an actuator mounted to the housing; and a compression device movably mounted within the chamber and operably coupled to the actuator, the compression device comprising a feed slot through which the collapsible bladder extends, the feed slot comprising an upper wall and a lower wall that engage opposite sides of the collapsible bladder to compress a portion of the collapsible bladder located in the feed slot; and wherein actuation of the actuator translates the compression device in a first longitudinal direction in the internal chamber to dispense the oral care material from the dispenser, translation of the compression device causing the upper wall and lower wall to move in sliding contact with the collapsible bladder; and wherein the dispenser further comprises an elongated operating slot and a pair of racks located on opposite sides of the operating slot, each of the pair of racks comprising a plurality of teeth, the teeth protruding toward a center of the operating slot.

2. The oral care system according to claim 1, wherein sliding the actuator from a first end of the collapsible bladder towards a second open end of the collapsible bladder dispenses the oral care material from the collapsible bladder.

3. The oral care system according to claim 2, wherein the actuator is operably coupled to the compression device by a stem projecting through an operating slot formed in the housing that extends along the longitudinal axis.

4. The oral care system according to claim 1, wherein the upper and lower walls of the feed slot are a monolithic portion of the compression device.

5. The oral care system according to claim 1, further comprising a ratchet mechanism including:

the pair of gear racks formed on either side of the operating slot, the operating slot formed in the housing and extending along the longitudinal axis; and a pair of indexing protrusions formed on the actuator or the stem, each indexing protrusion configured to engage one of the gear racks;

wherein sliding the actuator along the gear racks creates a plurality of indexed movements of the compression device to dispense a predetermined dose of the oral care material with each indexed movement.

6. The oral care system according to claim 1, wherein the oral care material is dispensed through an applicator mounted in a distal end of the dispenser, the applicator in fluid communication with the collapsible bladder.

7. The oral care system according to claim 6, wherein the applicator includes a dispensing orifice in fluid communication with the collapsible bladder.

8. The oral care system according to claim 6, wherein a distal end of the collapsible bladder includes a nozzle coupled to a tubular socket formed in a rear of the applicator, the tubular socket having a central passageway in fluid communication with the nozzle of the collapsible bladder.

9. The oral care system according to claim 1, wherein a proximal end of the collapsible bladder is non-movably coupled to the housing of the dispenser.

10. The oral care system according to claim 9, wherein actuation of the actuator translates the compression device in the first longitudinal direction relative to the collapsible bladder, the collapsible bladder remaining substantially stationary during translation of the compression device.

11. A product dispenser comprising:

a housing having an internal chamber and a longitudinal axis;

a collapsible bladder disposed in the chamber, the collapsible bladder containing a fluidic material and including a distal end for dispensing the fluidic material and a sealed proximal end;

the housing including a clamping member lockingly engaged with the proximal end of the collapsible bladder and holding the collapsible bladder in position during dispensing the fluidic material;

an actuator mounted to the housing; and a compression device movably mounted within the chamber and operably coupled to the actuator, the compression device comprising a feed slot through which the collapsible bladder extends, the feed slot comprising an upper wall and a lower wall that engage opposite sides of the collapsible bladder to compress a portion of the collapsible bladder located in the feed slot; and wherein actuation of the actuator translates the compression device in a first longitudinal direction in the internal chamber to dispense the fluidic material from the product dispenser, translation of the compression device causing the upper wall and lower wall to move in sliding contact with the collapsible bladder; and wherein the dispenser further comprises an elongated operating slot and a pair of racks located on opposite sides of the operating slot, each of the pair of racks comprising a plurality of teeth, the teeth protruding toward a center of the operating slot.

12. The product dispenser according to claim 11, wherein sliding the actuator from a first end of the collapsible bladder towards a second open end of the collapsible bladder dispenses the oral care material from the collapsible bladder and wherein the actuator is operably coupled to the compression device by a stem projecting through an operating slot formed in the housing that extends along the longitudinal axis.

13. The product dispenser according claim 11, wherein the actuator has a flat bottom surface that slideably engages mating top flat surfaces that extend longitudinally on the housing of the dispenser.

14. The product dispenser according to claim 11, further comprising a ratchet mechanism including:

the pair of gear racks formed on either side of the operating slot, the operating slot formed in the housing and extending along the longitudinal axis; and a pair of indexing protrusions formed on the actuator or the stem, each indexing protrusion configured to engage one of the gear racks;

wherein sliding the actuator along the gear racks creates a plurality of indexed movements of the compression device to dispense a predetermined dose of the oral care material with each indexed movement.

15. The product dispenser according to claim 11, wherein the oral care material is dispensed through an applicator mounted in a distal end of the dispenser, the applicator in fluid communication with the collapsible bladder.

16. The product dispenser according to claim 15, wherein a distal end of the collapsible bladder includes a nozzle coupled to a tubular socket formed in a rear of the applicator, the tubular socket having a central passageway in fluid communication with the nozzle of the collapsible bladder.

17. The product dispenser according to claim 11, wherein a proximal end of the collapsible bladder is non-movably coupled to the housing.

18. The product dispenser according to claim 17, wherein actuation of the actuator translates the compression device in the first longitudinal direction relative to the collapsible bladder, the collapsible bladder remaining substantially stationary during translation of the compression device.

19. The product dispenser according to claim 11, wherein the clamping member is disposed on an end wall of the housing inside the internal chamber.

20. The product dispenser according to claim 11, wherein the clamping member comprises a split structure including an upper half and a lower half configured to grip opposing sides of the proximal end of the collapsible bladder.

21. A method for dispensing a material, the method comprising:

providing a dispenser including a longitudinal axis, an internal chamber, a collapsible bladder disposed in the chamber and containing a material, and a compression device movably mounted within the chamber, the collapsible bladder including a distal end for dispensing the material and a sealed proximal end, the compression device comprising a feed slot comprising an upper wall and a lower wall, the dispenser further comprising an elongated operating slot and a pair of racks located on opposite sides of the operating slot, each of the pair of racks comprising a plurality of teeth, the teeth protruding toward a center of the operating slot;

engaging a clamping member of the housing with the proximal end of the collapsible bladder to hold the collapsible bladder in position within the internal chamber;

actuating an actuator operably coupled to the compression device;

translating the compression device in a first longitudinal direction;

engaging opposite sides of the collapsible bladder with the upper and lower walls of the compression device; and extruding the material from the dispenser.

* * * * *